US006178555B1

(12) United States Patent
Williams

(10) Patent No.: US 6,178,555 B1
(45) Date of Patent: Jan. 30, 2001

(54) LOWER LEG AND FOOT COVER

(76) Inventor: Robert Williams, 4032 Worrilow Rd., Brookhaven, PA (US) 19015

( * ) Notice: Under 35 U.S.C. 154(b), the term of this patent shall be extended for 0 days.

(21) Appl. No.: 09/288,133

(22) Filed: Apr. 8, 1999

(51) Int. Cl.[7] ..... A41D 13/00
(52) U.S. Cl. ..... 2/22; 2/242; 2/24
(58) Field of Search ..... 2/22, 23, 24, 69, 2/242, 455; 36/1.5, 2 R; 602/16, 23, 26, 28, 62, 65

(56) References Cited

U.S. PATENT DOCUMENTS

| | | | | |
|---|---|---|---|---|
| 1,624,129 | * | 4/1927 | Barrett | 2/22 |
| 2,717,387 | * | 9/1955 | McMahan | 2/22 |
| 2,982,968 | * | 5/1961 | Groot | 2/22 |
| 3,772,704 | * | 11/1973 | Carbonneau | 2/22 |
| 4,057,853 | * | 11/1977 | McLane | 2/22 |
| 4,599,812 | * | 7/1986 | Harmsen | 36/1.5 |
| 4,633,529 | * | 1/1987 | Litz | 2/22 |
| 4,692,946 | * | 9/1987 | Jurga | 2/22 |
| 5,452,475 | * | 9/1995 | Hunt | 2/22 |
| 5,469,637 | * | 11/1995 | Adam | 36/2 R |
| 5,613,250 | * | 3/1997 | Bell | 2/242 |
| 5,682,613 | * | 11/1997 | Dinatale | 2/168 |
| 5,732,411 | * | 3/1998 | Coleman et al. | 2/22 |
| 5,806,092 | * | 9/1998 | Shikatani | 2/22 |
| 5,829,055 | * | 11/1998 | Collins et al. | 2/22 |
| 5,896,676 | * | 4/1999 | Barousse | 36/2 R |
| 5,970,525 | * | 10/1999 | Gallinot et al. | 2/242 |

* cited by examiner

*Primary Examiner*—Gloria M. Hale
*Assistant Examiner*—Tejash Patel

(57) ABSTRACT

A lower leg and foot cover for covering the knee and lower leg regions of a user's pants and the front of the user's shoes from soiling and soaking. The lower leg and foot cover includes a knee cover which is coupled to an upper end of a flexible lower leg cover. A flexible shoe cover is coupled to a lower end of the lower leg cover. Flexible straps are provided for securing the knee cover and the lower leg cover to the wearer's leg.

8 Claims, 1 Drawing Sheet

LOWER LEG AND FOOT COVER

BACKGROUND OF THE INVENTION

1. Field of the Invention

The present invention relates to articles for protecting a user's pants and shoes from soiling and more particularly pertains to a new lower leg and foot cover for covering the knee and lower leg regions of a user's pants and the front of the user's shoes from soiling and soaking.

2. Description of the Prior Art

The use of articles for protecting a user's pants and shoes from soiling is known in the prior art. More specifically, articles for protecting a user's pants and shoes from soiling heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,982,968; U.S. Pat. No. 2,249,553; U.S. Pat. No. 5,611,080; U.S. Pat. No. 3,772,704; U.S. Pat. No. Des. 278,470; and U.S. Pat. No. 4,692,946.

While these devices fulfill their respective, particular objectives and requirements, the aforementioned patents do not disclose a new lower leg and foot cover. The inventive device includes a knee cover which is coupled to an upper end of a flexible lower leg cover. A flexible shoe cover is coupled to a lower end of the lower leg cover. Flexible straps are provided for securing the knee cover and the lower leg cover to the wearer's leg.

In these respects, the lower leg and foot cover according to the present invention substantially departs from the conventional concepts and designs of the prior art, and in so doing provides an apparatus primarily developed for the purpose of covering the knee and lower leg regions of a user's pants and the front of the user's shoes from soiling and soaking.

SUMMARY OF THE INVENTION

In view of the foregoing disadvantages inherent in the known types of articles for protecting a user's pants and shoes from soiling now present in the prior art, the present invention provides a new lower leg and foot cover construction wherein the same can be utilized for covering the knee and lower leg regions of a user's pants and the front of the user's shoes from soiling and soaking.

The general purpose of the present invention, which will be described subsequently in greater detail, is to provide a new lower leg and foot cover apparatus and method which has many of the advantages of the articles for protecting a user's pants and shoes from soiling mentioned heretofore and many novel features that result in a new lower leg and foot cover which is not anticipated, rendered obvious, suggested, or even implied by any of the prior art articles for protecting a user's pants and shoes from soiling, either alone or in any combination thereof.

To attain this, the present invention generally comprises a knee cover which is coupled to an upper end of a flexible lower leg cover. A flexible shoe cover is coupled to a lower end of the lower leg cover. Flexible straps are provided for securing the knee cover and the lower leg cover to the wearer's leg.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lower leg and foot cover apparatus and method which has many of the advantages of the articles for protecting a user's pants and shoes from soiling mentioned heretofore and many novel features that result in a new lower leg and foot cover which is not anticipated, rendered obvious, suggested, or even implied by any of the prior art articles for protecting a user's pants and shoes from soiling, either alone or in any combination thereof.

It is another object of the present invention to provide a new lower leg and foot cover which may be easily and efficiently manufactured and marketed.

It is a further object of the present invention to provide a new lower leg and foot cover which is of a durable and reliable construction.

An even further object of the present invention is to provide a new lower leg and foot cover which is susceptible of a low cost of manufacture with regard to both materials and labor, and which accordingly is then susceptible of low prices of sale to the consuming public, thereby making such lower leg and foot cover economically available to the buying public.

Still yet another object of the present invention is to provide a new lower leg and foot cover which provides in the apparatuses and methods of the prior art some of the advantages thereof, while simultaneously overcoming some of the disadvantages normally associated therewith.

Still another object of the present invention is to provide a new lower leg and foot cover for covering the knee and lower leg regions of a user's pants and the front of the user's shoes from soiling and soaking.

Yet another object of the present invention is to provide a new lower leg and foot cover which includes a knee cover which is coupled to an upper end of a flexible lower leg cover. A flexible shoe cover is coupled to a lower end of the lower leg cover. Flexible straps are provided for securing the knee cover and the lower leg cover to the wearer's leg.

Still yet another object of the present invention is to provide a new lower leg and foot cover that protects the lower regions of a user's pants and the user's shoes from paint, cement, and plaster splatters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
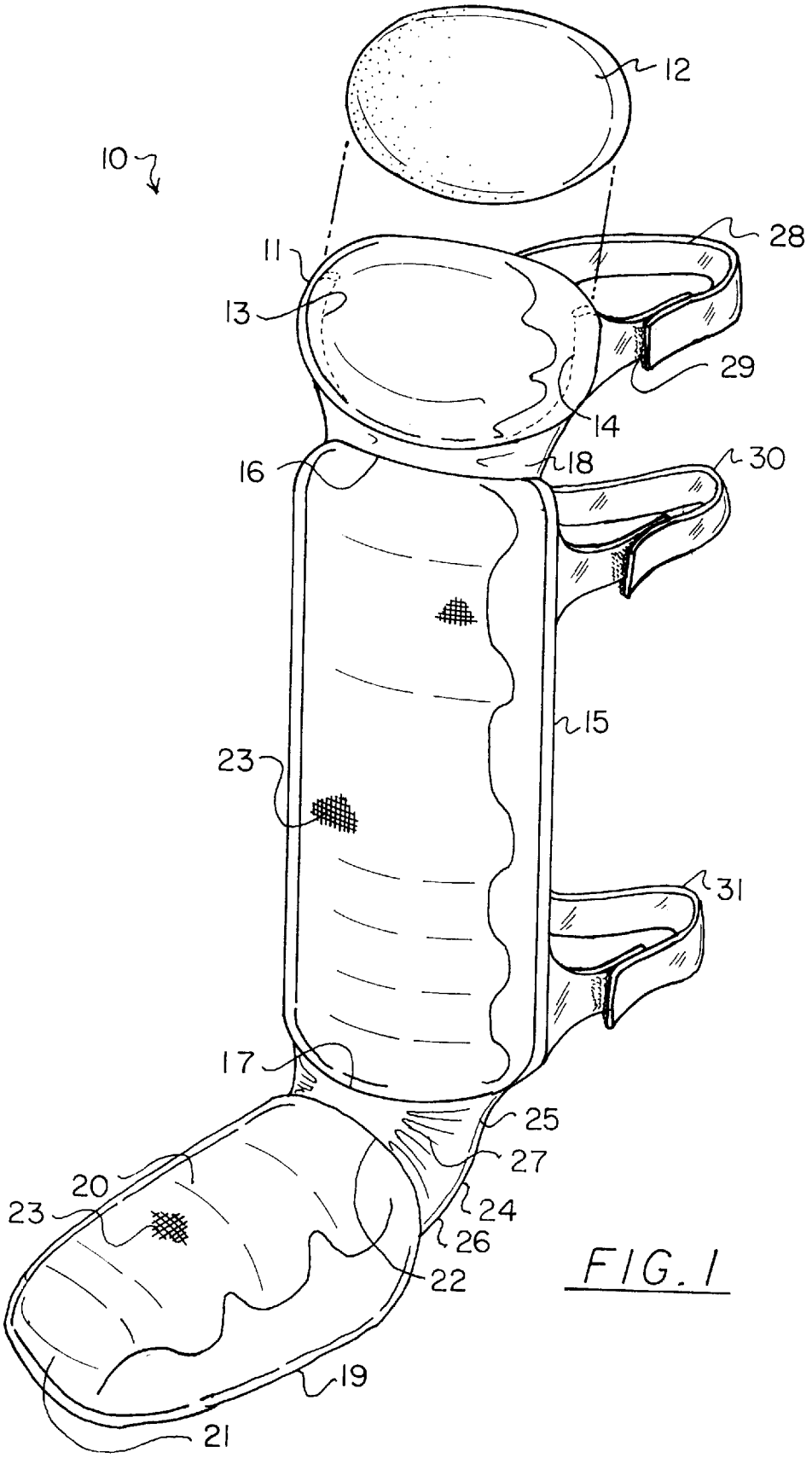
FIG. 1 is a schematic front perspective view of a new lower leg and foot cover according to the present invention with the pad detached from the knee cover.

With reference now to the drawings, and in particular to FIG. 1 thereof, a new lower leg and foot cover embodying the principles and concepts of the present invention and generally designated by the reference numeral 10 will be described.

As best illustrated in FIG. 1, the lower leg and foot cover 10 generally comprises a knee cover which is coupled to an upper end of a flexible lower leg cover. A flexible shoe cover is coupled to a lower end of the lower leg cover. Flexible straps are provided for securing the knee cover and the lower leg cover to the wearer's leg.

In use, the cover 10 is designed for protecting the front of a wearer's lower leg region and the front of the wearer's shoe from soiling and splatters such as from splashes, precipitation, paint over-spray, and even cement and plaster splatters and spills. In closer detail the cover 10 includes a generally oval-shaped knee cover 11 designed for covering a knee region of a wearer. The knee cover comprises a rigid material such as a hard plastic material to provide additional protection when the wearer is kneeling. Preferably, a generally oval shaped resiliently deformable pad 12 is detachably attached to a back face of the knee cover such that the pad is designed for interposing between the knee cover and the wearer's knee. Even more preferably, the pad comprises a resiliently deformable foamed material. In the preferred embodiment, the back face of the knee cover ideally has a pair of opposing rails 13,14 defining a pair of channels between the rails and the back face of the knee cover, the pad is inserted into the channels to detachably attach the pad to the back face of the knee cover.

The cover 10 also includes a flexible lower leg cover 15 designed for covering the front of a shin region of the wearer. The lower leg cover has a generally rectangular outer perimeter and upper and lower ends 16,17. The upper end of the lower leg cover is coupled to the knee cover. Preferably, the upper end of the lower leg cover has a flexible connecting flap 18 coupling the upper end of the lower leg cover to the knee cover.

The cover 10 further includes a flexible shoe cover 19 designed for covering a toe region and front upper region of a shoe of the wearer. The shoe cover has an upper portion 20 designed for positioning over the front upper region of the wearer's shoe and a front region 21 designed for positioning in front of the toe region of the wearer's shoe. The shoe cover has a back end 22 located adjacent the upper region of the shoe cover. The back end of the shoe cover is connected to the lower end of the lower leg cover such that the shoe cover forwardly extends from the lower end of the lower leg cover.

The lower leg cover and the shoe cover each comprises a flexible water repellant material for repelling or resisting the passage of water through the lower leg cover and that also has pores therethrough designed for permitting the passage of air through the lower leg cover. Ideally, the lower leg cover comprises a water repellant, breathable laminated fabric 23 such as microporous polytetrafluoroethylene, commonly known under the trade-name "GORE-TEX" and which is made by stretching polymer in a controlled was so as to create fine fore which allow diffusion of air and water vapor but prevent liquid water ingress.

A generally right-angled-bent ankle cover 24 is interposed between the lower end of the lower leg cover and the back end of the shoe cover to connect the lower end of the lower leg cover and the back end of the shoe cover. The ankle cover is designed for covering the front of the wearer's ankle. The ankle cover has upper and lower portions 25,26 generally extending at a right-angle to one another. The upper portion of the ankle connector is positioned adjacent the lower end of the lower leg cover and the lower portion of the ankle cover is positioned adjacent the back end of the shoe cover.

The ankle cover comprises a resiliently deflectable material such as a resiliently deflectable plastic material that is also water impermeable to permit passage of water therethrough to permit deflecting of the upper and lower portions of the ankle cover with respect to one another so that the ankle cover does not excessively hinder the wearer's walk. The ankle cover also preferably has a plurality of pleats 27 or grooves for aiding deflection of the ankle cover.

The knee cover has a flexible strap 28 designed for wrapping around the back of the wearer's knee to secure the knee cover to the wearer's knee. The strap of the knee cover preferably has a break therein and a hook and loop fastener 29 connecting together ends of the strap of the knee cover formed by the break of the strap of the knee cover. Similarly, the lower leg cover has a pair of flexible straps 30,31 designed for wrapping around the back of the wearer's lower leg to secure the lower leg cover to the wearer's lower leg. A first of the straps 30 of the lower leg cover is positioned adjacent the upper end of the lower leg cover while a second of the straps 31 of the lower leg cover is positioned adjacent the lower end of the lower leg cover. Like the strap of the knee cover, the straps of the lower leg cover each preferably have a break therein and a hook and loop fastener connecting together ends of the respective strap formed by the break of the particular strap.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cover for protecting the front of a wearer's lower leg region and the front of the wearer's shoe from soiling and splatters, comprising:

a knee cover adapted for covering a knee region of a wearer;

a flexible lower leg cover being adapted for covering the front of a lower leg region of the wearer, said lower leg cover having upper and lower ends;

said upper end of said lower leg cover being coupled to said knee cover;

a flexible shoe cover adapted for covering a toe region and front upper region of a shoe of the wearer, said shoe cover having an upper portion adapted for positioning over the front upper region of the wearer's shoe and a front region adapted for positioning in front of the toe region of the wearer's shoe;

said shoe cover having a back end located adjacent said upper region of said shoe cover, said back end of said shoe cover being connected to said lower end of said lower leg cover such that said shoe cover forwardly extends from said lower end of said lower leg cover;

flexible straps for securing said knee cover and said lower leg cover to the wearer's legs a resiliently deformable pad being detachably attached to a back face of said knee cover such that said pad is adapted for interposing between said knee cover and the wearer's knee; and wherein said back face of said knee cover has a pair of opposing rails defining a pair of channels between said rails and said back face of said knee cover, said pad being inserted into said channels to detachably attach said pad to said back face of said knee cover.

2. The cover of claim 1, wherein said knee cover comprises a rigid material.

3. The cover of claim 1, wherein said upper end of said lower leg cover having a flexible connecting flap coupling said upper end of said lower leg cover to said knee cover.

4. The cover of claim 1, wherein said lower leg cover and said shoe cover each comprise a flexible water repellant material for resisting the passage of water through said lower leg cover and knee cover and flexible water repellant material having pores therethrough adapted for permitting the passage of air through said lower leg cover and knee cover.

5. The cover of claim 1, further comprising ankle cover being interposed between said lower end of said lower leg cover and said back end of said shoe cover to connect said lower end of said lower leg cover and said back end of said shoe cover, said ankle cover being adapted for covering the front of the wearer's ankle, said ankle cover having upper and lower portions, said upper portion of said ankle connector being positioned adjacent said lower end of said lower leg cover, said lower portion of said ankle cover being positioned adjacent said back end of said shoe cover.

6. The cover of claim 7, wherein said ankle cover comprises a resiliently deflectable material to permit deflecting of said upper and lower portions of said ankle cover with respect to one another.

7. The cover of claim 8, wherein said ankle cover has a plurality of pleats for aiding deflection of said ankle cover.

8. A cover for protecting the front of a wearer's lower leg region and the front of the wearer's shoe from soiling and splatters, comprising:

a generally oval-shaped knee cover adapted for covering a knee region of a wearer, said knee cover comprising a rigid material;

a generally oval shaped resiliently deformable pad being detachably attached to a back face of said knee cover such that said pad is adapted for interposing between said knee cover and the wearer's knee, said pad comprising a resiliently deformable foamed material;

said back face of said knee cover having a pair of opposing rails defining a pair of channels between said rails and said back face of said knee cover, said pad being inserted into said channels to detachably attach said pad to said back face of said knee cover;

a flexible lower leg cover being adapted for covering the front of a shin region of the wearer, said lower leg cover having a generally rectangular outer perimeter and upper and lower ends;

said upper end of said lower leg cover being coupled to said knee cover, wherein said upper end of said lower leg cover having a flexible connecting flap coupling said upper end of said lower leg cover to said knee cover;

a flexible shoe cover adapted for covering a toe region and front upper region of a shoe of the wearer, said shoe cover having an upper portion adapted for positioning over the front upper region of the wearer's shoe and a front region adapted for positioning in front of the toe region of the wearer's shoe;

said shoe cover having a back end located adjacent said upper region of said shoe cover, said back end of said shoe cover being connected to said lower end of said lower leg cover such that said shoe cover forwardly extends from said lower end of said lower leg cover;

said lower leg cover and said shoe cover each comprising a flexible water repellant material for resisting the passage of water through said lower leg cover and having pores therethrough adapted for permitting the passage of air through said lower leg cover;

an ankle cover being interposed between said lower end of said lower leg cover and said back end of said shoe cover to connect said lower end of said lower leg cover and said back end of said shoe cover;

said ankle cover being adapted for covering the front of the wearer's ankle;

said ankle cover having upper and lower portions, said upper portion of said ankle connector being positioned adjacent said lower end of said lower leg cover, said lower portion of said ankle cover being positioned adjacent said back end of said shoe cover;

said ankle cover comprising a resiliently deflectable material to permit deflecting of said upper and lower portions of said ankle cover with respect to one another;

said ankle cover having a plurality of pleats for aiding deflection of said ankle cover;

said knee cover having a flexible strap adapted for wrapping around the back of the wearer's knee to secure the knee cover to the wearer's knee, said strap of said knee cover having a break therein and a hook and loop fastener connecting together ends of said strap of said knee cover formed by said break of said strap of said knee cover;

said lower leg cover having a pair of flexible straps adapted for wrapping around the back of the wearer's lower leg to secure the lower leg cover to the wearer's lower leg, said straps of said lower leg cover each having a break therein and a hook and loop fastener connecting together ends of the respective strap formed by the break of the particular strap; and a first of said straps of said lower leg cover being positioned adjacent said upper end of said lower leg cover, a second of said straps of said lower leg cover being positioned adjacent said lower end of said lower leg cover.

* * * * *